US011506192B1

(12) United States Patent
Olney et al.

(10) Patent No.: US 11,506,192 B1
(45) Date of Patent: Nov. 22, 2022

(54) MANUAL DRIVER ASSEMBLY FOR A PULSATILE FLUID PUMP

(71) Applicant: VentriFlo, Inc., Pelham, NH (US)

(72) Inventors: David Olney, Chester, NH (US); Douglas E. Vincent, Pelham, NH (US); Laura S. Cleminson, Stratham, NH (US); Lawrence Kuba, Nashua, NH (US); Michael Cole, Stratham, NH (US); Roger Greeley, Portsmouth, NH (US)

(73) Assignee: VentriFlo, Inc., Pelham, NH (US)

( * ) Notice: Subject to any disclaimer, the term of this patent is extended or adjusted under 35 U.S.C. 154(b) by 0 days.

(21) Appl. No.: 17/404,475

(22) Filed: Aug. 17, 2021

(51) Int. Cl.
*F04B 43/02* (2006.01)
*F04B 43/00* (2006.01)

(52) U.S. Cl.
CPC ..... *F04B 43/02* (2013.01); *F04B 43/00* (2013.01)

(58) Field of Classification Search
CPC ..... F04B 9/14; F04B 17/02–05; F04B 33/00; F04B 33/02; F04B 33/005; F04B 43/02; F04B 47/024
USPC ..... 417/374
See application file for complete search history.

(56) References Cited

U.S. PATENT DOCUMENTS 2,228,714 A * 1/1941 Wiltse ..... F04B 9/06 417/374
3,700,361 A * 10/1972 De Vries ..... F04B 43/1253 417/477.8
5,432,968 A * 7/1995 Beck ..... B25F 1/006 7/128
9,121,400 B1 * 9/2015 Myers ..... F04B 53/1047

FOREIGN PATENT DOCUMENTS

WO WO-2018119499 A1 * 7/2018

* cited by examiner

*Primary Examiner* — Philip E Stimpert
(74) *Attorney, Agent, or Firm* — Sunstein LLP

(57) ABSTRACT

A pulsatile fluid pump apparatus includes an integral pump assembly employing a flexible diaphragm in a diaphragm assembly; a pulsatile fluid pump system including a control housing, for removably receiving the integral pump assembly, the control housing and the integral pump assembly being configured for operation, in a first mode, so that the pulsatile fluid pump system reciprocally actuates the diaphragm assembly to cause pumping automatically; and a manual driver assembly, wherein the integral pump assembly is configured, in a second mode, in the absence of actuation of the diaphragm assembly by the pulsatile fluid pump system, to removably receive the manual driver assembly to support manual actuation and operation of the diaphragm assembly.

11 Claims, 14 Drawing Sheets

MANUAL DRIVER ASSEMBLY FOR A PULSATILE FLUID PUMP

TECHNICAL FIELD

The present invention relates to pulsatile fluid pumps, and more particularly to pulsatile fluid pumps suitable for pumping blood.

BACKGROUND ART

A pulsatile fluid pump is taught in U.S. Pat. No. 7,850,593 ("our prior patent") for an invention of Douglas Vincent and Matthew Murphy; Douglas Vincent is a co-inventor of the present invention. Our prior patent discloses a pump actuated by a linear motor configured to cause reciprocation of a flexible membrane, serving as a wall of a fluid housing, that is in turn coupled to a pair of ball valves, in a manner as to implement pulsatile fluid flow.

The present application is related to four applications bearing U.S. patent application Ser. Nos. 17/182,915, 17/182,893, 17/183,067, and 17/183,080, respectively. Each of these related applications is hereby incorporated herein by reference in its entirety.

SUMMARY OF THE EMBODIMENTS

In accordance with one embodiment of the invention, a pulsatile fluid pump apparatus includes an integral pump assembly employing a flexible diaphragm in a diaphragm assembly; a pulsatile fluid pump system including a control housing, for removably receiving the integral pump assembly, the control housing and the integral pump assembly being configured for operation, in a first mode, so that the pulsatile fluid pump system reciprocally actuates the diaphragm assembly to cause pumping automatically; and a manual driver assembly, wherein the integral pump assembly is configured, in a second mode, in the absence of actuation of the diaphragm assembly by the pulsatile fluid pump system, to removably receive the manual driver assembly to support manual actuation and operation of the diaphragm assembly.

Alternatively or in addition, the integral pump assembly is configured to operate in any spatial orientation. Also alternatively or in addition, for operation in the first mode, the diaphragm assembly has a normal orientation in the control housing so as to be in contact with a pushrod assembly to cause reciprocation of the flexible diaphragm.

Further alternatively or in addition, the integral pump assembly is configured to slide into and out of the control housing. Alternatively or in addition, the integral pump assembly is configured, in the second mode, to be in an inverted orientation in the control housing relative to the normal orientation of the diaphragm assembly, so as to expose the diaphragm assembly for convenient attachment of the manual driver assembly. In the second mode, the pulsatile fluid pump system is not operationally connected to the integral pump assembly and therefore does not cause reciprocation of the diaphragm assembly.

Alternatively or in addition, the control housing is configured to receive and hold the integral pump assembly in the inverted orientation. Also alternatively or in addition, the manual driver assembly includes an arm configured to be pivotally mounted to a housing of the integral pump assembly, and the arm is coupled to a handle having a foot that reciprocally moves the diaphragm assembly when the handle is pumped.

Alternatively or in addition, the manual driver assembly includes a stroke volume limiter, disposed between the handle and the foot, and configured to limit, by an adjustable amount, a change in stroke volume effectuated by the manual driver assembly. Also alternatively or in addition, the stroke volume limiter defines a plurality of notched orientations, each orientation establishing a distinct limit on travel of the manual driver assembly.

Further alternatively or in addition, the pulsatile fluid pump system has an integral storage location for stowing the manual driver assembly when it is not being used.

In accordance with a related embodiment of the invention, the manual driver assembly is a knob assembly.

BRIEF DESCRIPTION OF THE DRAWINGS

The foregoing features of embodiments will be more readily understood by reference to the following detailed description, taken with reference to the accompanying drawings, in which:

FIGS. 7A-D are side perspective views of the pulsatile fluid pump apparatus 300 showing the manual driver assembly 600 attached to the integral pump assembly 200, which is mounted in the pulsatile fluid pump system 301 in the manual operating position.

FIG. 7A shows the handle in the full up, or diastole, position with the stroke volume limiter 621 shown in the largest stroke volume limit position.

FIG. 7B shows the handle in the full down, or systole, position with the stroke volume limiter 621 shown in the largest stroke volume limit position.

FIG. 7C is similar to FIG. 7A except the stroke volume limiter 621 is shown in the smallest stroke volume limit position.

FIG. 7D is similar to FIG. 7B except the stroke volume limiter 621 is shown in the smallest stroke volume limit position.

FIGS. 8A-D are views of the manual driver assembly 600 attached to the integral pump assembly 200 (for clarity, shown outside of the pulsatile fluid pump system 301) in the manual operating position.

FIG. 8A is a cutaway interior view of the manual driver assembly 600 attached to a vertical section of the integral pump assembly 200 in manual orientation in the diastole mode, with the stroke volume limiter 621 in the largest setting.

FIG. 8B is a cutaway interior view of the manual driver assembly 600 attached to a vertical section of the integral pump assembly 200 in manual orientation, midway between the full diastole and full systole positions, with the stroke volume limiter 621 in the largest setting.

FIG. 8C is a cutaway interior view of the manual driver assembly 600 attached to a vertical section of the integral pump assembly 200 in manual orientation, in the systole mode, with the stroke volume limiter 621 in the largest setting.

FIG. 8D is a view of the manual driver assembly 600 attached to a vertical section of the integral pump assembly 200 in manual orientation, in the systole mode, with the stroke volume limiter 621 in the smallest setting.

FIG. 12A shows a perspective view of the manual driver knob assembly 690 in accordance with an embodiment of the present invention.

FIG. 12B shows a front view of the manual driver knob assembly 690 of FIG. 12A.

FIG. 12C shows the manual driver knob assembly 690 of FIG. 12A, immediately prior to attachment to the diaphragm assembly 201 via the coupler slot 214*a*.

FIG. 12D shows the manual driver knob assembly 690 of FIG. 12A after attachment to the diaphragm assembly 201 via the coupler slot 214*a*, ready for manual pumping.

DETAILED DESCRIPTION OF SPECIFIC EMBODIMENTS

Figure 1:
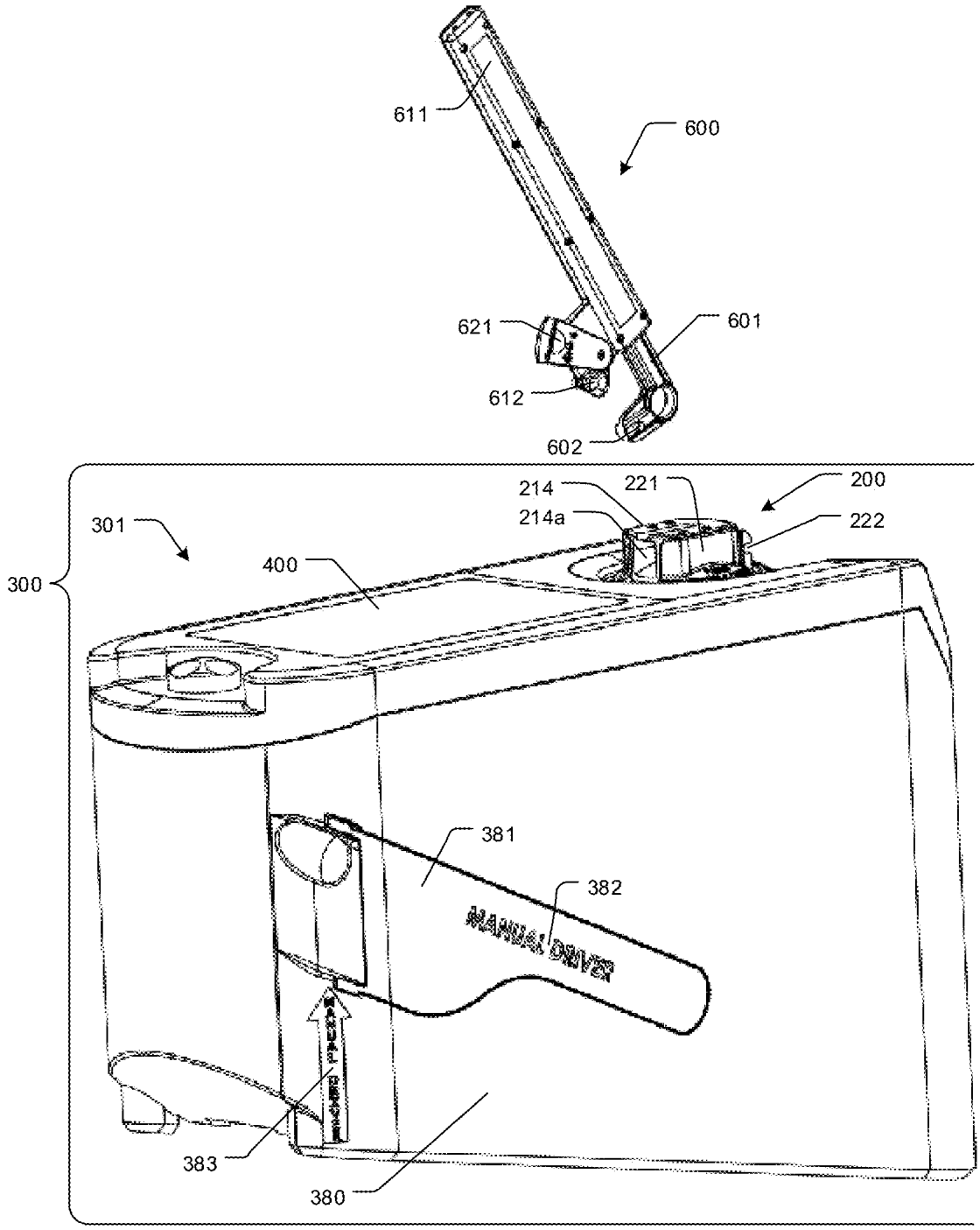
FIG. 1 is a side perspective view of a pulsatile fluid pump apparatus 300 comprised of a pulsatile fluid pump system 301, integral pump assembly 200 and manual driver assembly 600, in accordance with an embodiment of the present invention.

Definitions. As used in this description and the accompanying claims, the following terms shall have the meanings indicated, unless the context otherwise requires:

"Diastole mode" is a phase of operation of a pulsatile pump, according to embodiments of the present invention, during which the diaphragm 202 (not shown) of the pump-valving assembly 101 (not shown) is pulled away from the chamber 102 (not shown) so as to create negative pressure within the chamber 102 (not shown).

"Systole mode" is a phase of operation of a pulsatile pump, according to embodiments of the present invention, during which the diaphragm 202 (not shown) is pushed towards the chamber 102 (not shown), so as to create positive pressure within the chamber 102 (not shown).

"Normal operating position" is when the integral pump assembly 200 is inserted into the pulsatile fluid pump system 301 with the coupler slot 214*a* in a downwards orientation such that the coupler slot 214*a* engages with push rod 342 (not shown) for normal, automated operation.

Figure 5A:
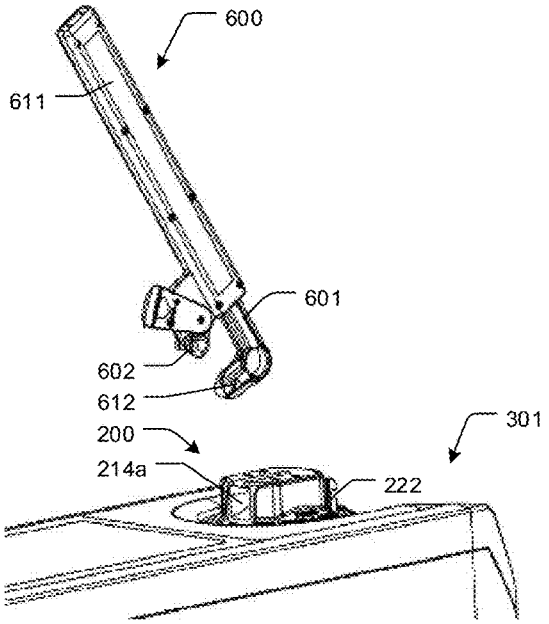
FIGS. 5A-D show successive actions used to attach the manual driver assembly 600 of FIG. 1 to the integral pump housing 200.
Figure 5B:
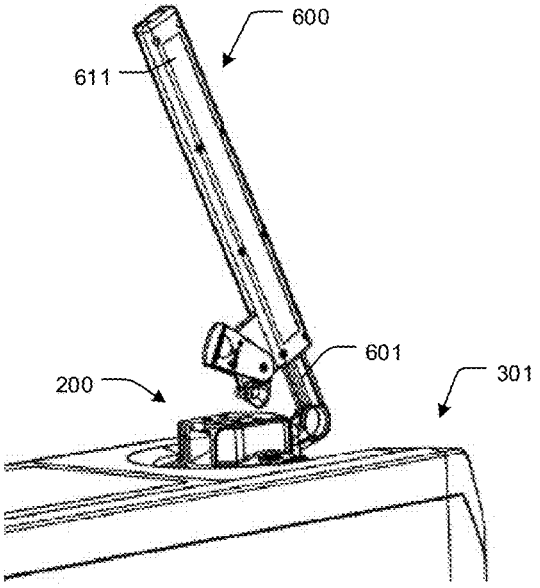

"Manual operating position" is when the integral pump assembly 200 is inserted into the pulsatile fluid pump system 301 with the coupler slot 214*a* facing in an upwards orientation so that the manual driver assembly 600 may be attached to the integral pump housing 200 by hooking the pump housing engagement pin 602 into the pump housing manual driver notch 222 as shown in FIG. 5B.

A "set" includes at least one member.

The term "physical flow characteristic" includes a measured attribute such as stroke strength, beat rate, flow rate, average flow rate 411*a*, stroke volume 411*b*, flow index 411*c*, pulse pressure, flow rate waveform 412, and stroke volume waveform 413, as well as combinations of any of the foregoing attributes.

The manual driver assembly 600 is a component of a pulsatile fluid pump system 301 in accordance with an embodiment of the present invention.

FIG. 1 is a side perspective view of a pulsatile fluid pump apparatus 300 including a pulsatile fluid pump system 301, integral pump assembly 200 and manual driver assembly 600, in accordance with an embodiment of the present invention. The pulsatile fluid pump system 301 has an enclosure 380 containing, among other things, manual driver storage 381. The manual driver storage 381 is identified by side labeling 382 and corner labeling 383 to aid the operator in identifying and locating the manual driver assembly 600. The integral pump assembly 200 contains, among other things, a coupler 214 with coupler slot 214*a*, a pump housing 221, and a pump housing manual driver notch 222. (In these figures, like numbered items correspond to similar components across different figures and across the applications bearing U.S. patent application Ser. Nos. 17/182,915, 17/182,893, 17/183,067, and 17/183,080)

Figure 2:
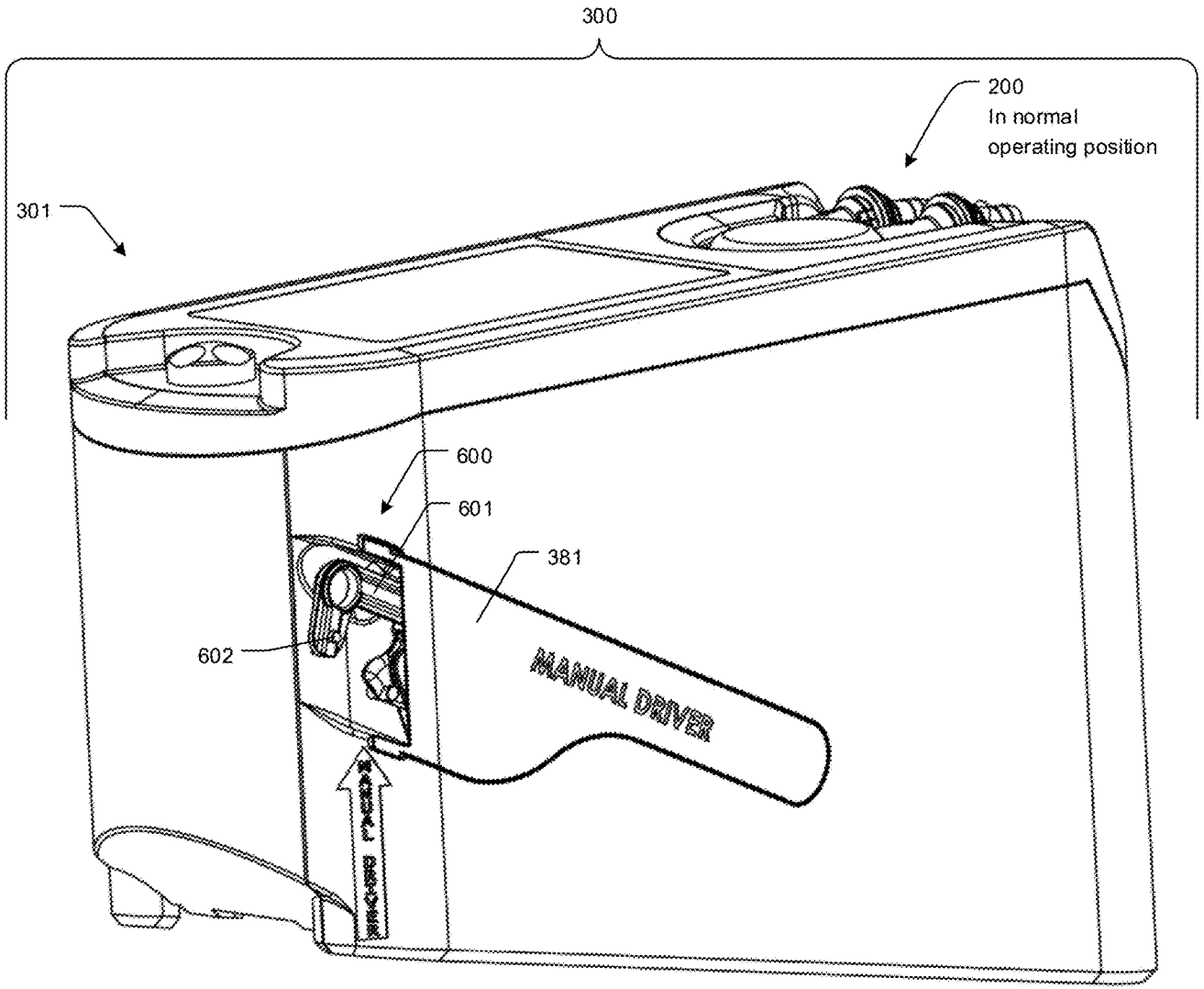
FIG. 2 is a similar side perspective view of the pulsatile fluid pump apparatus 300 of FIG. 1 showing the manual driver assembly 600 stowed in the manual driver storage 381.

FIG. 2 is a similar side perspective view of the pulsatile fluid pump apparatus 300 of FIG. 1, showing the manual driver assembly 600 stowed in the manual driver storage 381. This arrangement allows the manual driver to be visible and immediately available to the operator in case it is needed. The integral pump assembly 200 is shown in the normal operating position, where the integral pump assembly 200 is inserted into the pulsatile fluid pump system 301 with the coupler slot 214*a* (shown in FIG. 1) in a downwards orientation such that the coupler slot 214*a* (shown in FIG. 1) engages with push rod 342 (shown in FIGS. 12A-B).

Figure 3:
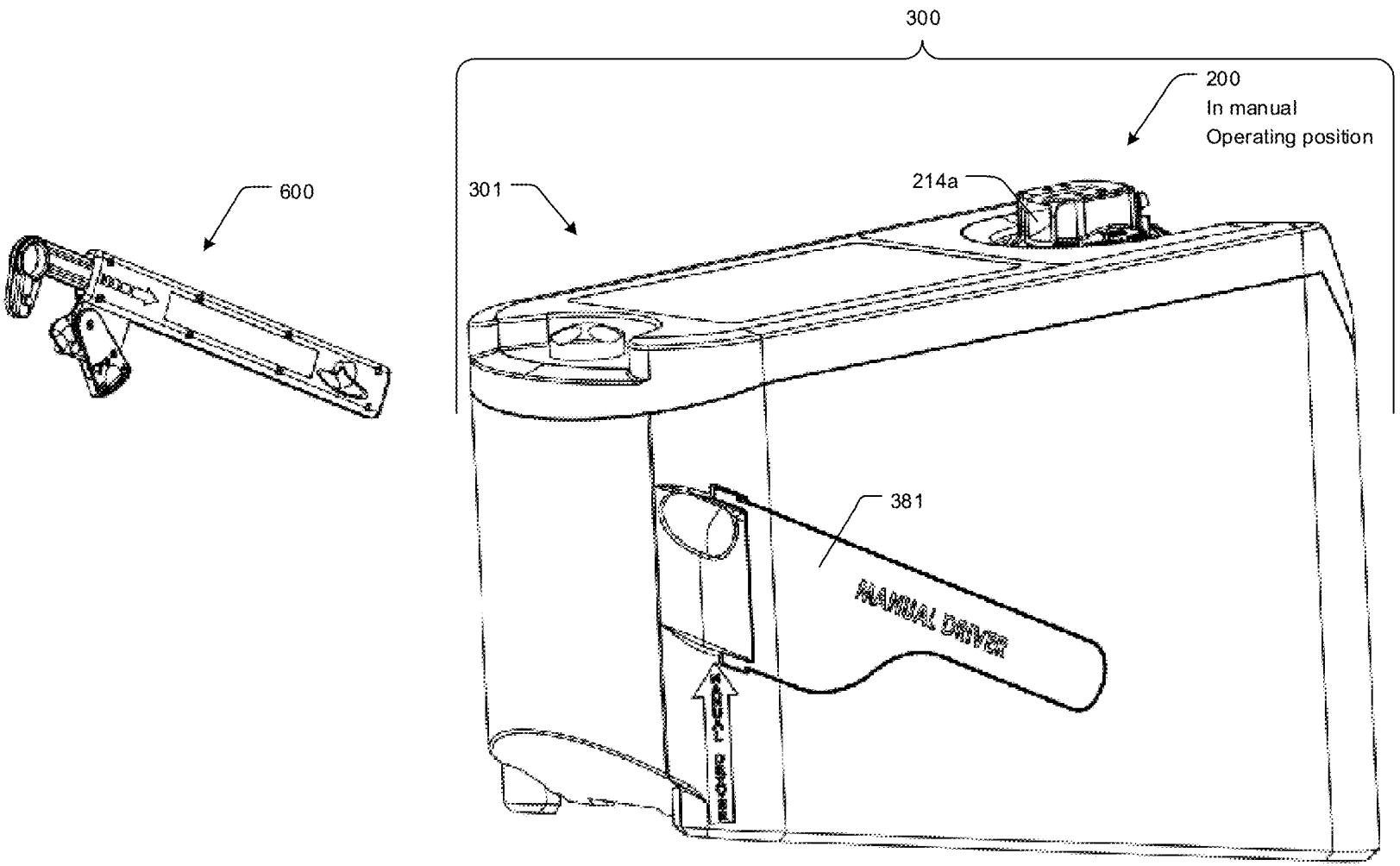
FIG. 3 is a side view of the pulsatile fluid pump apparatus 300 showing the manual driver assembly 600 removed from the manual driver storage 381 with the integral pump assembly 200 placed in the manual operating position.

FIG. 3 is a side view of the pulsatile fluid pump apparatus 300 showing the manual driver assembly 600 removed from the manual driver storage 381. The integral pump assembly 200 is shown in the manual operating position—accomplished by removing the integral pump assembly 200 from the pulsatile fluid pump system 301, flipping it upside down, then re-inserting it back into the pulsatile fluid pump system 301 with the coupler slot 214*a* facing in an upwards orientation so that the manual driver assembly 600 may be attached to the integral pump housing 200. Should the pulsatile fluid pump system 301 once again become operational, the integral pump assembly 200 may once again be removed from the pulsatile fluid pump system 301, then re-inserted back into the pulsatile fluid pump system 301 in the normal operating position and the manual driver assembly 600 returned to manual driver storage 381.

Figure 4A:
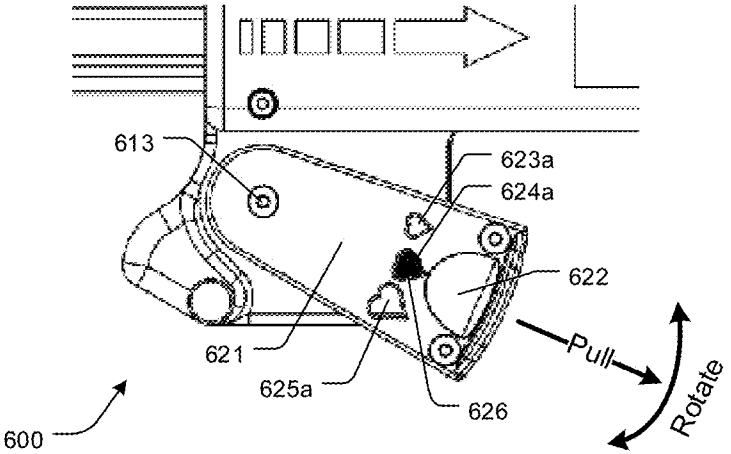
FIG. 4A is a closeup of the manual driver assembly 600 showing a stroke volume limiter 621 having three stroke volume limit settings.

FIG. 4A is a closeup of the manual driver assembly 600 showing a stroke volume limiter 621 having three stroke volume limit settings: smallest (indicated by the small stroke volume limit indicator window 623*a*), intermediate (indicated by the medium stroke volume limit indicator window 624*a*), and largest (indicated by the large stroke volume limit indicator window 625*a*) stroke volume limit, guiding the operator to deliver the desired stroke volume to the patient. While three stroke volume limit settings are disclosed herein, it is expressly contemplated that the stroke volume limiter may have less than three stroke volume limit settings or more than three stroke volume limit settings. Once removed from manual driver storage 381 (shown in FIG. 1), the manual driver assembly 600 is adjusted to the desired stroke limit setting (as indicated by the corresponding stroke volume limit indicator window 623*a*, 624*a*, 625*a*) by adjusting the stroke volume limiter 621. This is accomplished by pulling on the stroke volume limiter finger grip 622 to cause the stroke volume limiter 621 to cause the stroke volume limiter pin 613 to compress the stroke volume limiter spring 614 (shown in FIGS. 4B-D). With the stroke volume limiter spring 614 (shown in FIGS. 4B-D) compressed, the stroke volume limiter 621 may be rotated around the stroke volume limiter pin 613 such that the stroke volume limiter protrusion 615 (shown in FIGS. 4B-D) engages with one of three stroke volume limit notches (small stroke volume limit notch 623*b* [shown in FIGS. 4B-D], medium stroke volume limit notch 624*b* [shown in FIGS. 4B-D], or large stroke volume limit notch 625*b* [shown in FIGS. 4B-D]) when the stroke volume limiter 621 is released. The selected stroke volume limit indicator 626 is a contrasting color that shows through the selected stroke volume limit indicator window 623*a*, 624*a*, 625*a*. The stroke volume limit setting may be changed at any time.

Figure 4B:
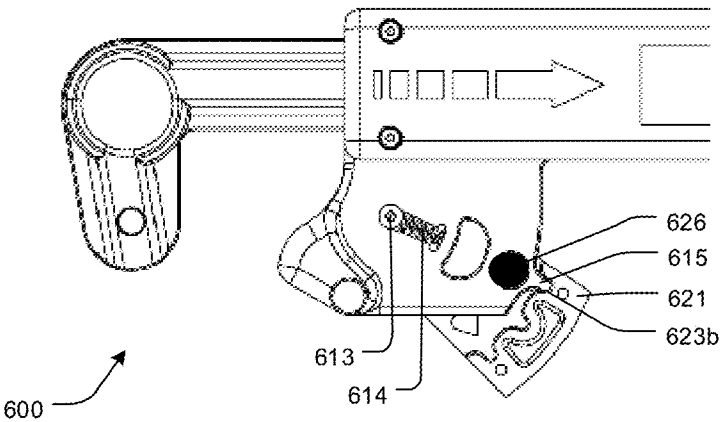
FIG. 4B shows the manual driver assembly 600 of FIG. 4A with a cutaway interior view of the stroke volume limiter 621 set to the smallest stroke volume setting.

FIG. 4B is a cutaway view of the manual driver assembly 600 of FIG. 4A that shows the stroke volume limiter 621 set to the smallest stroke volume setting as the stroke volume limiter protrusion 615 is shown engaged with the small stroke volume limit notch 623*b*. In this position, the stroke volume limit indicator 626 is visible through the small stroke volume limit indicator window 623*a* (shown in FIG. 4A).

Figure 4C:
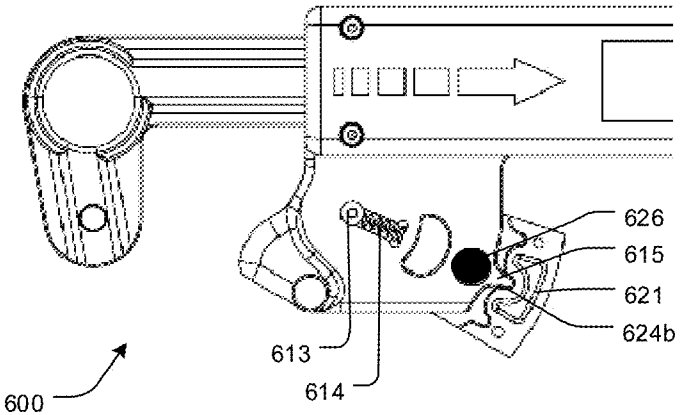
FIG. 4C shows the manual driver assembly 600 of FIG. 4A with a cutaway interior view of the stroke volume limiter 621 set to an intermediate stroke volume setting.

FIG. 4C is a cutaway view of the manual driver assembly 600 of FIG. 4A that shows the stroke volume limiter 621 set to the intermediate stroke volume setting as the stroke volume limiter protrusion 615 is shown engaged with the medium stroke volume limit notch 624*b*. In this position, the stroke volume limit indicator 626 is visible through the medium stroke volume limit indicator window 624*a* (shown in FIG. 4A).

Figure 4D:
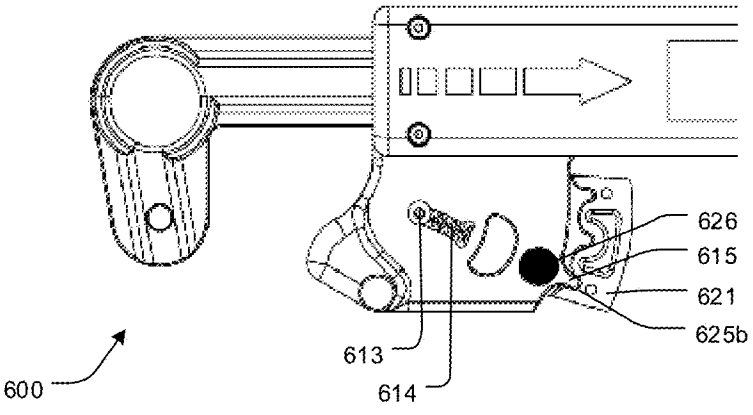
FIG. 4D shows the manual driver assembly 600 of FIG. 4A with a cutaway interior view of the stroke volume limiter 621 set to the largest stroke volume setting.

FIG. 4D is a cutaway view of the manual driver assembly 600 of FIG. 4A that shows the stroke volume limiter 621 set to the largest stroke volume setting as the stroke volume limiter protrusion 615 is shown engaged with the large stroke volume limit notch 625*b*. In this position, the stroke volume limit indicator 626 is visible through the large stroke volume limit indicator window 625*a* (shown in FIG. 4A).

Figure 5C:
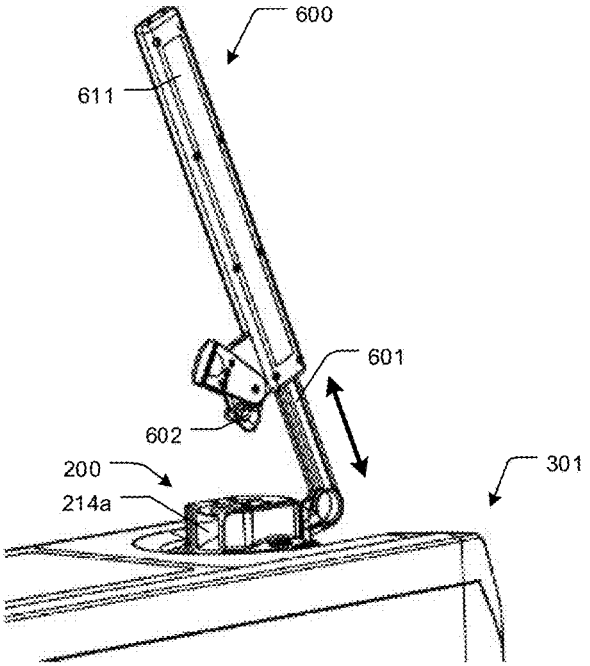
Figure 5D:
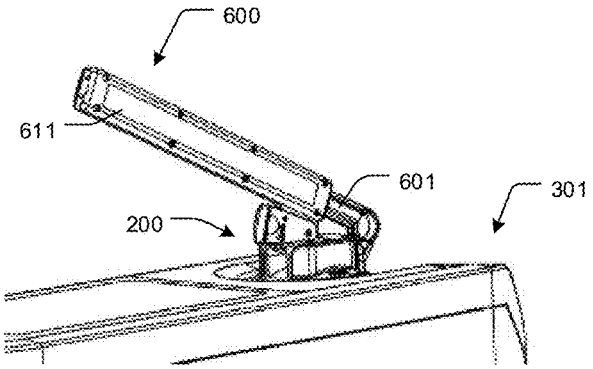

FIGS. 5A-D shows successive actions used to attach the manual driver assembly 600 of FIG. 1 to the integral pump housing 200. As shown in FIG. 5A, the coupler slot 214*a* is in the manual operating position so that the manual driver assembly 600 may be attached to the integral pump housing 200. FIG. 5B shows the pump housing engagement pin 602 being hooked into the pump housing manual driver notch 222. As shown in FIG. 5C, pulling on the handle 611 extends the spring-loaded arm 601 allowing the handle 611 to rotate around the diameter of the pump housing engagement pin 602 such that the coupler slot engagement pin 612 aligns to the coupler slot 214*a*. As shown in FIG. 5D, the handle 611 is released causing the tension spring 616 (shown in FIG. 6A) to retract the spring-loaded arm 601 into the handle 611 pulling the coupler slot engagement pin 612 into the coupler slot 214*a*. The manual driver assembly is kept engaged in the two slots 214*a*, 222 by the tension spring 616 (shown in FIG. 6A) contained within the handle 611.

Figure 6A:
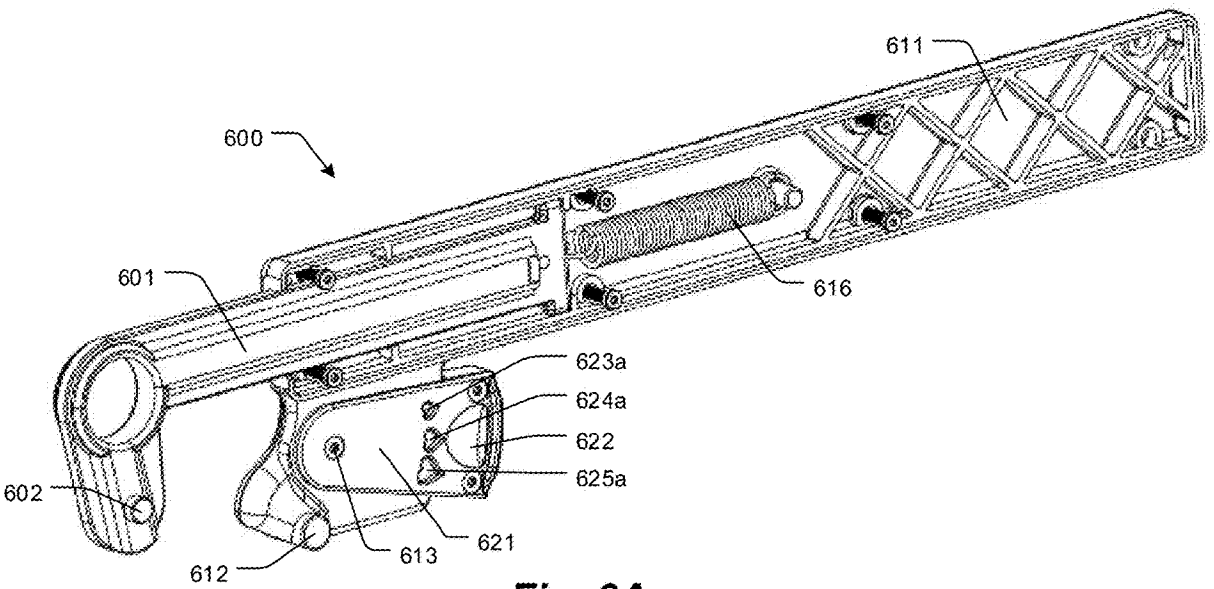
FIG. 6A is a cutaway interior perspective view of the manual driver assembly 600.

FIG. 6A is a cutaway perspective view showing the interior of the manual driver assembly 600 including the spring-loaded arm 601 (with pump housing engagement pin 602) and the handle 611 (with coupler slot engagement pin 612, stroke volume limiter pin 613, tension spring 616, and stroke volume limiter 621). The stroke volume limiter 621 has a stroke volume limiter finger grip 622 and three stroke volume limit indicator windows: the small stroke volume limit indicator window 623*a*, the medium stroke volume limit indicator window 624*a*, and the large stroke volume limit indicator window 625*a*.

Figure 6B:
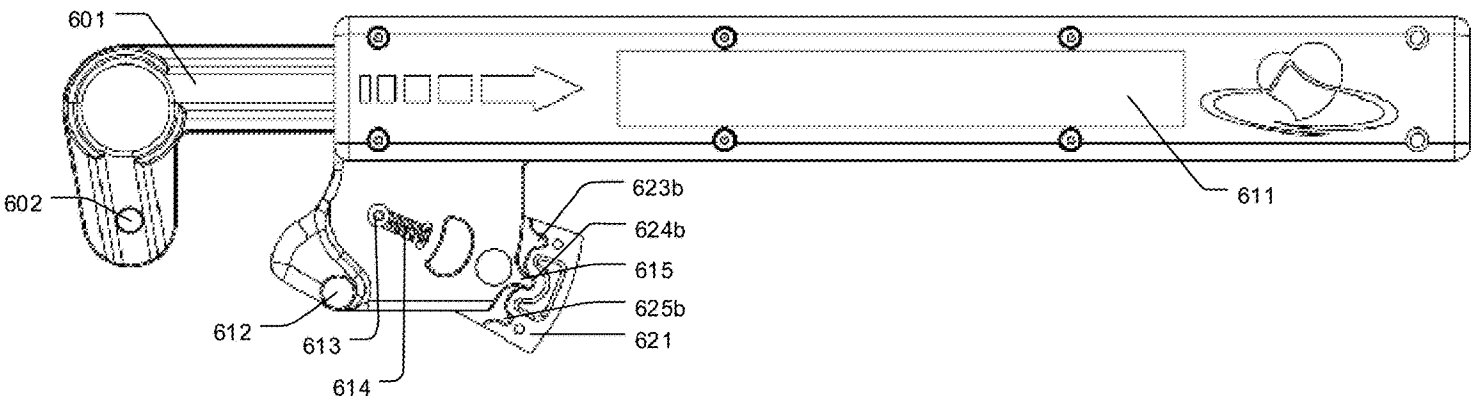
FIG. 6B shows the manual driver assembly 600 with a cutaway interior view of the stroke volume limiter 621.

FIG. 6B shows the manual driver assembly 600 including the spring-loaded arm 601 (with pump housing engagement pin 602) and the handle 611 (with coupler slot engagement pin 612, stroke volume limiter pin 613, stroke volume limiter spring 614, and stroke volume limiter 621). The cutaway interior view of the stroke volume limiter 621 shows the stroke volume limiter protrusion 615 and three stroke volume limit notches: the small stroke volume limit notch 623*b*, the medium stroke volume limit notch 624*b*, and the large stroke volume limit notch 625*b*.

FIGS. 7A-D & 8A-D show operation of the manual driver assembly 600 in a pumping sequence and of the function of the stroke volume limiter 621. Fluid flow during manual pumping is analogous to fluid flow during automated pumping, as more fully described in the applications bearing U.S. patent application Ser. Nos. 17/182,915, 17/182,893, 17/183,067, and 17/183,080.

FIGS. 7A-D are side perspective views of the pulsatile fluid pump apparatus 300 showing the manual driver assembly 600 attached to the integral pump assembly 200 which is mounted within the pulsatile fluid pump system 301 in the manual operating position.

Figure 7A:
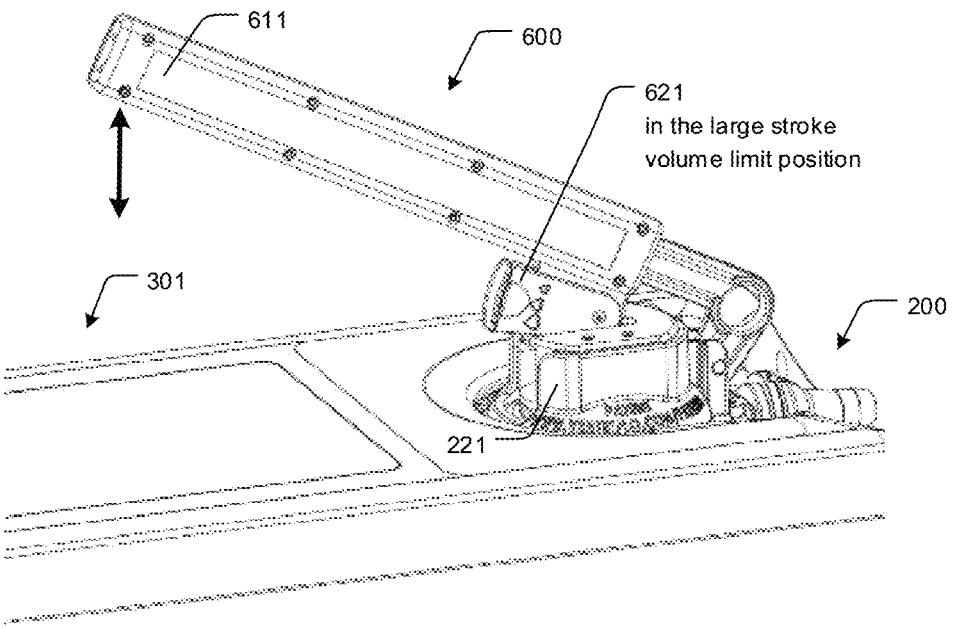
FIGS. 7A-D & 8A-D show operation of the manual driver assembly in a pumping sequence and of the stroke volume limiter 621.

FIGS. 7A (and 7C & 8A) shows the handle in the full up, or diastole, position with the stroke volume limiter 621 shown in the largest stroke volume limit position. As the handle 611 is raised, the integral pump assembly 200 experiences diastole mode just as if the push rod 342 (shown in FIGS. 11A-B) was pulled away from the integral pump assembly 200; the diaphragm 202 (shown in FIG. 8A) acts as a natural travel limiter to the upwards force. In this part of the stroke, the stroke volume limiter 621, regardless of setting, does not exert an influence, as it does not contact the pump housing 221.

Figure 7B:
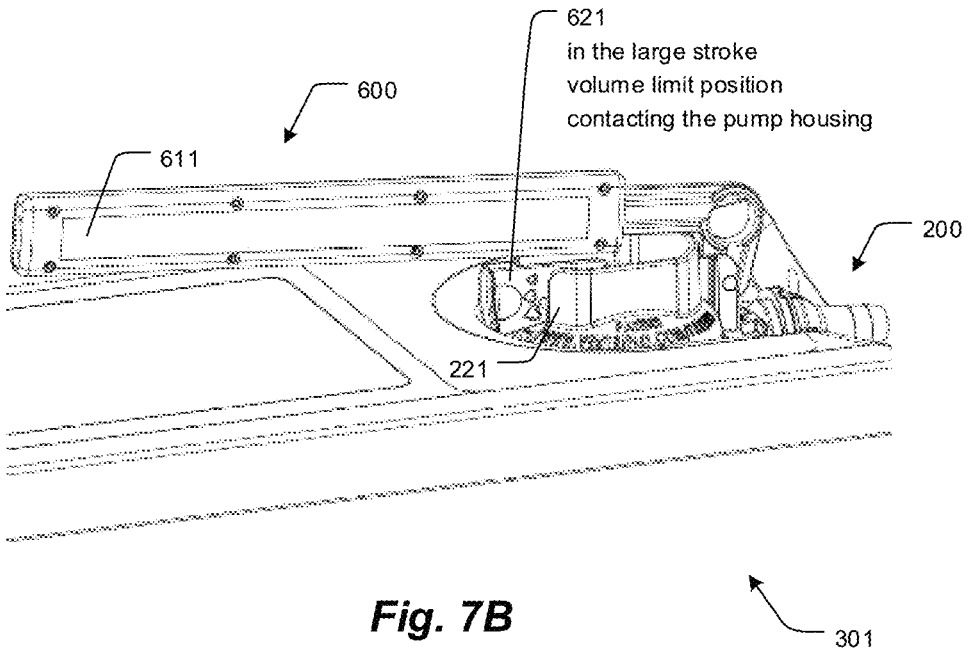

FIGS. 7B (and 7D, 8C, & 8D) shows the handle in the full down, or systole, position. As the handle 611 is depressed, the integral pump assembly 200 experiences systole mode just as if the push rod 342 (shown in FIGS. 11A-B) was pushed towards the integral pump assembly 200. Shown in the largest stroke volume limit position, the stroke volume limiter 621 limits the amount of downward travel of the handle 611 by contacting the pump housing 221, which in turn limits the stroke volume delivered.

Figure 7C:
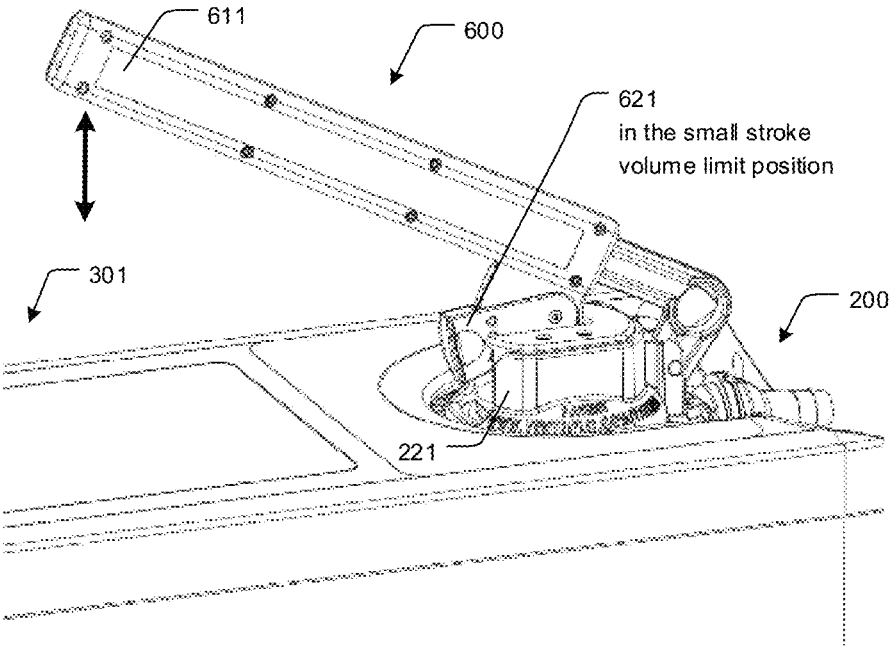

FIG. 7C is similar to FIG. 7A except the stroke volume limiter 621 is shown in the smallest stroke volume limit position. Similar to what is shown in FIG. 7A, in this part of the stroke, the stroke volume limiter 621, regardless of setting, does not exert an influence, as it does not contact the pump housing 221. In contrast with what is shown in FIG. 7A, it is apparent that there is less distance between the stroke volume limiter 621 and the pump housing 221, thus less travel of the handle 611, and thereby less fluid pumped.

Figure 7D:
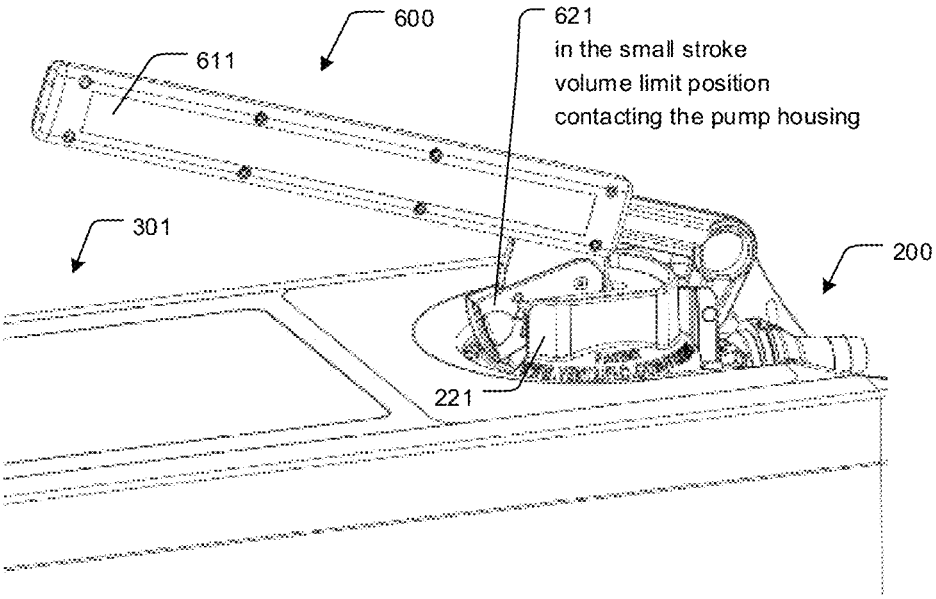

FIG. 7D is similar to FIG. 7B except the stroke volume limiter 621 is shown in the smallest stroke volume limit position. As the handle 611 is depressed, the integral pump assembly 200 experiences systole mode just as if the push rod 342 (shown in FIGS. 11A-B) was pushed towards the integral pump assembly 200. Shown in the smallest stroke volume limit position, the stroke volume limiter 621 limits the amount of downward travel of the handle 611 by contacting the pump housing 221, which in turn limits the stroke volume delivered. In contrast with what is shown in FIG. 7B, when the stroke volume limiter 621 is in the smallest stroke volume limit position, it allows less overall travel of the handle 611 than when it is in the largest stroke volume limit position, thereby pumping less fluid.

FIGS. 8A-D are views of the manual driver assembly 600 attached to the integral pump assembly 200 in the manual operating position. For clarity, the manual driver assembly 600 and the integral pump assembly 200 are shown outside of the pulsatile fluid pump system 301. The diaphragm 202 within the integral pump assembly 200 is actuated by raising and lowering the handle 611 to effect manual pumping. The beat rate is determined by the frequency at which the operator pumps the handle 611.

Figure 8A:
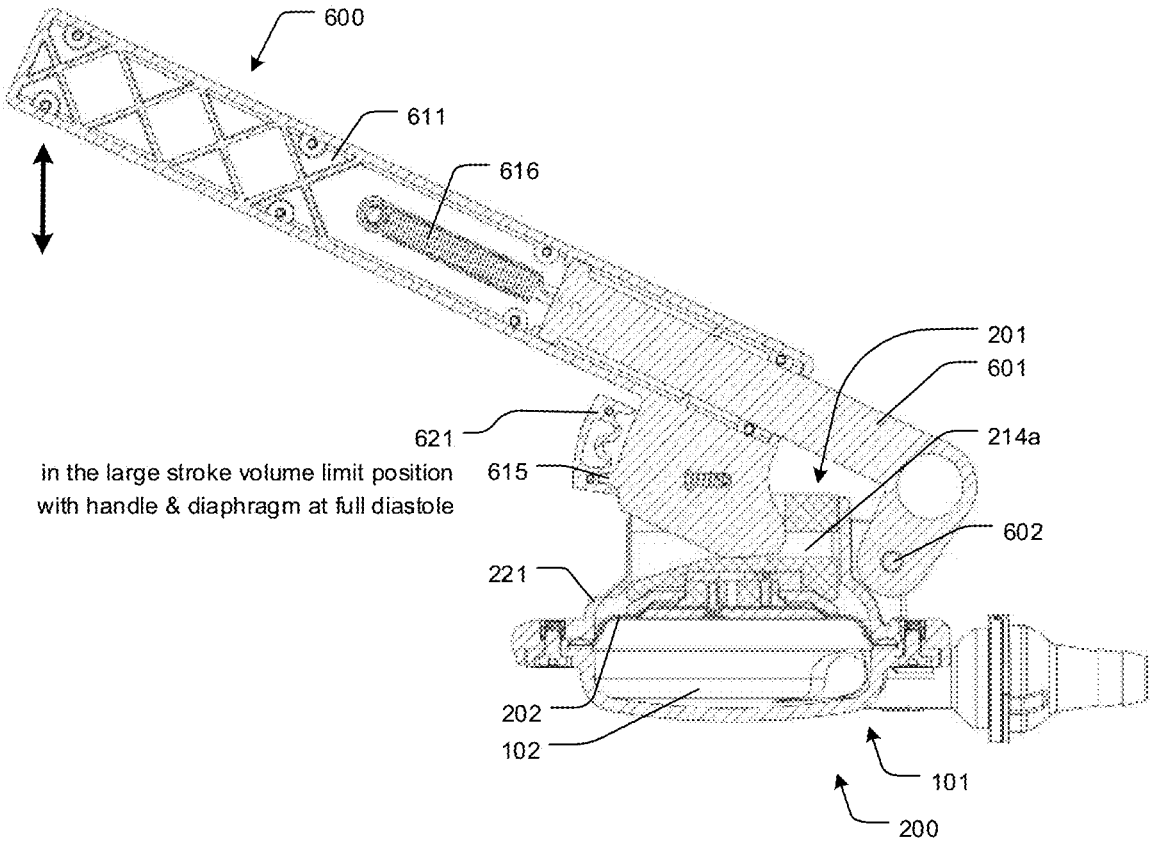

FIG. 8A is a cutaway interior view of the manual driver assembly 600 attached to a vertical section of the integral pump assembly 200 in manual orientation in the diastole mode, with the stroke volume limiter 621 in the largest setting. The manual driver assembly 600 includes the spring-loaded arm 601 (with pump housing engagement pin 602) and the handle 611 (with coupler slot engagement pin 612 [shown in FIG. 8D], tension spring 616, and stroke volume limiter 621), and the stroke volume limiter protrusion 615. FIG. 8A further shows a vertical section of the integral pump assembly 200 wherein the diaphragm assembly 201 is mounted to a pump-valving assembly 101 in diastole mode, in which the chamber 102 is full.

The spring-loaded arm 601 is shown in the retracted position, pulled towards the handle 611 by the tension spring 616. The pump housing engagement pin 602 is seated in the pump housing manual driver notch 222 (shown in FIG. 8D), and the coupler slot engagement pin 612 (shown in FIG. 8D) is seated in the coupler slot 214*a*; the engagement pins 602, 612 (shown in FIG. 8D) are held in their respective slots 222 (shown in FIG. 8D), 214*a* by the tension exerted by the tension spring 616 pulling the handle 611 and spring-loaded arm 601 together.

Similar to what is shown in FIG. 7A, FIG. 8A shows the handle in the full up, or diastole, position. As the handle 611 is raised, the integral pump assembly 200 experiences diastole mode just as if the push rod 342 (shown in FIGS. 11A-B) was pulled away from the integral pump assembly 200; the diaphragm 202 (shown in FIG. 8A) acts as a natural travel limiter to the upwards force. The stroke volume limiter 621 is in the largest stroke volume setting as indicated by the relative position of the stroke volume limiter 621 to the stroke volume limiter protrusion 615, although when in this part of the stroke, the stroke volume limiter 621 setting does not exert an influence, as it does not contact the pump housing 221.

Figure 8B:
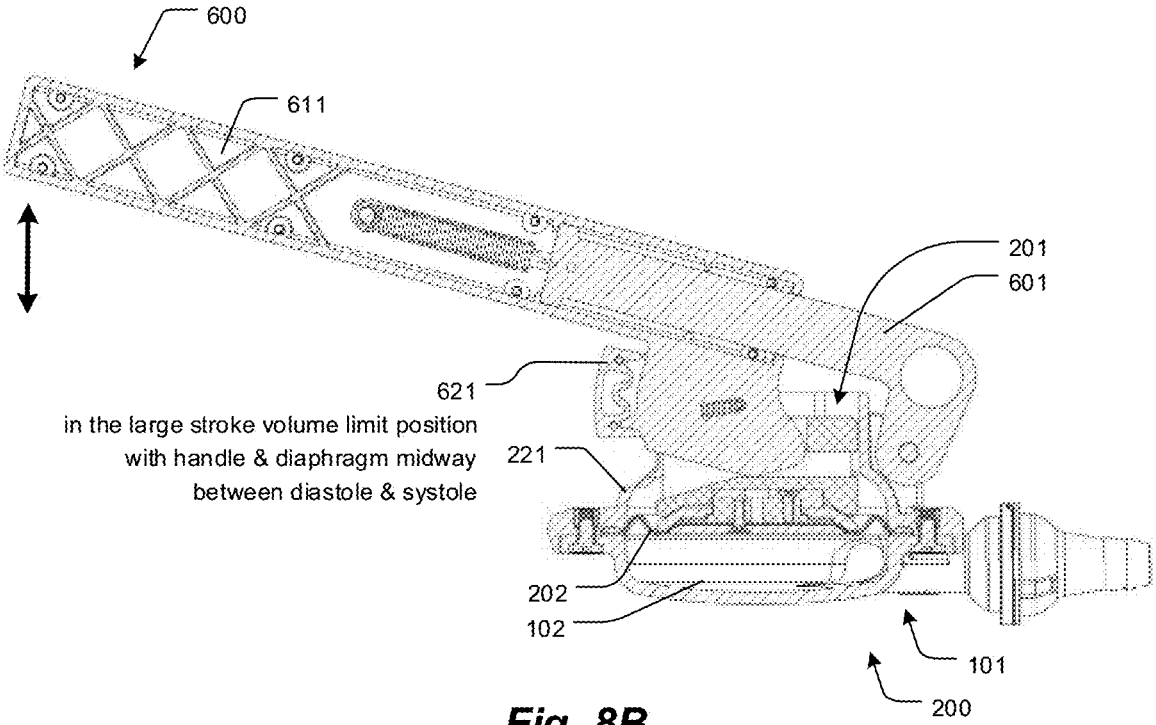

FIG. 8B is a cutaway interior view of the manual driver assembly 600 attached to a vertical section of the integral pump assembly 200 in manual orientation, midway between the diastole and systole modes, with the stroke volume limiter 621 in the largest setting. The stroke volume limiter 621 is shown in the largest stroke volume, although when in this part of the stroke, the stroke volume limiter 621 setting does not exert an influence, as it does not contact the pump housing 221. The manual driver assembly 600 includes the spring-loaded arm 601 and the handle 611 (with stroke volume limiter 621). The integral pump assembly 200 has a diaphragm assembly 201 that is mounted to a pump-valving assembly 101, shown in mid-stroke (either systole or diastole) in which the chamber 102 is being either filled (diastole) or emptied (systole).

Figure 8C:
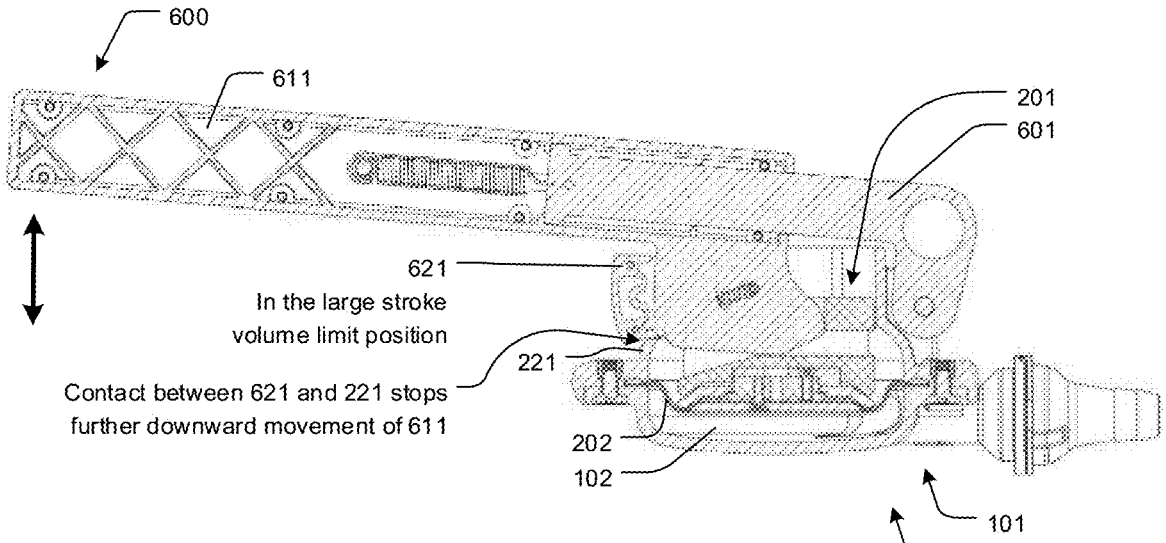

FIG. 8C is a cutaway interior view of the manual driver assembly 600 attached to a vertical section of the integral pump assembly 200 in manual orientation, in the systole mode, with the stroke volume limiter 621 in the largest setting. Similar to what is shown in FIG. 7B, FIG. 8C shows the handle in the full down, or systole, position with the stroke volume limiter 621 in the largest stroke volume setting, attached to the integral pump assembly 200 with the handle 611 in the systole position wherein the stroke volume limiter 621 is in contact with the pump housing 221, limiting further downward travel of the handle 611 and further compression of the diaphragm 202, thereby limiting the volume of fluid pumped.

FIG. 8C also shows a vertical section of the integral pump assembly 200 wherein diaphragm assembly 201 mounted to a pump-valving assembly 101 in systole mode, in which the chamber 102 is finished being emptied.

Figure 8D:
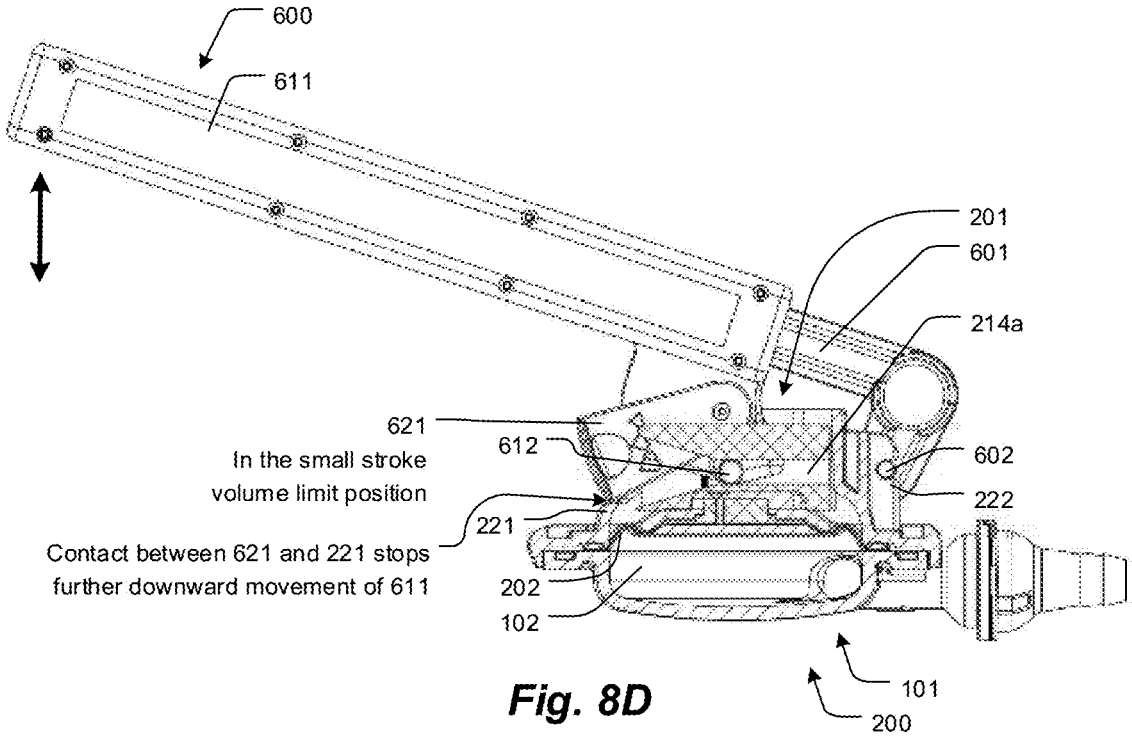

FIG. 8D is a view of the manual driver assembly 600 attached to a vertical section of the integral pump assembly 200 in manual orientation, in the systole mode, with the stroke volume limiter 621 in the smallest setting. Similar to what is shown in FIG. 7D, FIG. 8D shows the handle in the full down, or systole, position with the stroke volume limiter 621 in the smallest stroke volume limit position. The stroke volume limiter 621 limits the amount of downward travel of the handle 611 by contacting the pump housing 221, which in turn limits the stroke volume delivered. In this setting, the volume delivered is less than in FIG. 8C. The integral pump assembly 200 has a diaphragm assembly 201 mounted to a pump-valving assembly 101, shown in systole mode in which the chamber 102 is being emptied.

FIG. 8D shows the manual driver assembly 600 including the spring-loaded arm 601 (with pump housing engagement pin 602) and the handle 611 (with coupler slot engagement pin 612 and stroke volume limiter 621 with stroke volume limiter finger grip 622). The spring-loaded arm 601 is shown in the retracted position, pulled towards the handle 611 by the tension spring 616 (not shown). The pump housing engagement pin 602 is seated in the pump housing manual driver notch 222, and the coupler slot engagement pin 612 is seated in the coupler slot 214*a*; the engagement pins 602, 612 are held in their respective slots 222, 214*a* by the tension exerted by the tension spring 616 (not shown) pulling the handle 611 and spring-loaded arm 601 together.

Figure 9:
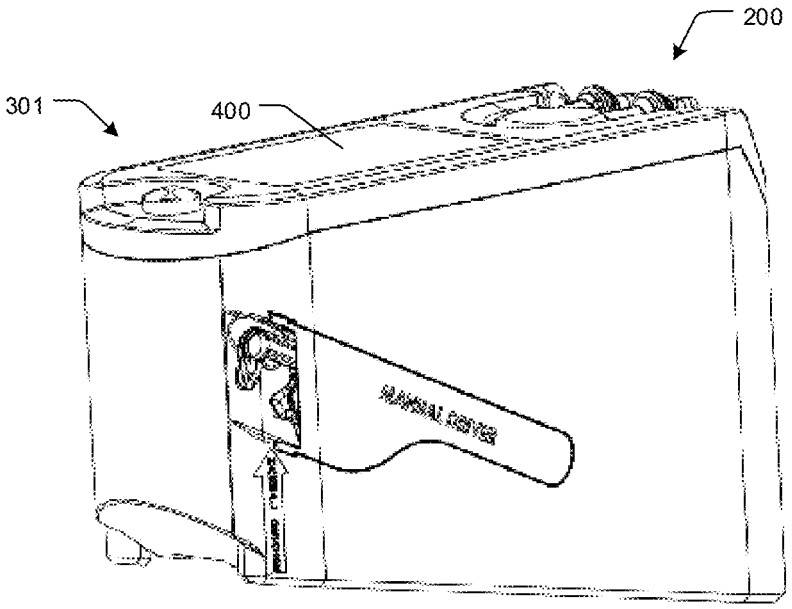
FIG. 9 shows the graphic display 400 mounted in the pulsatile fluid pump 301.

FIG. 9 shows a graphic display 400 mounted in the pulsatile fluid pump 301.

Figure 10:
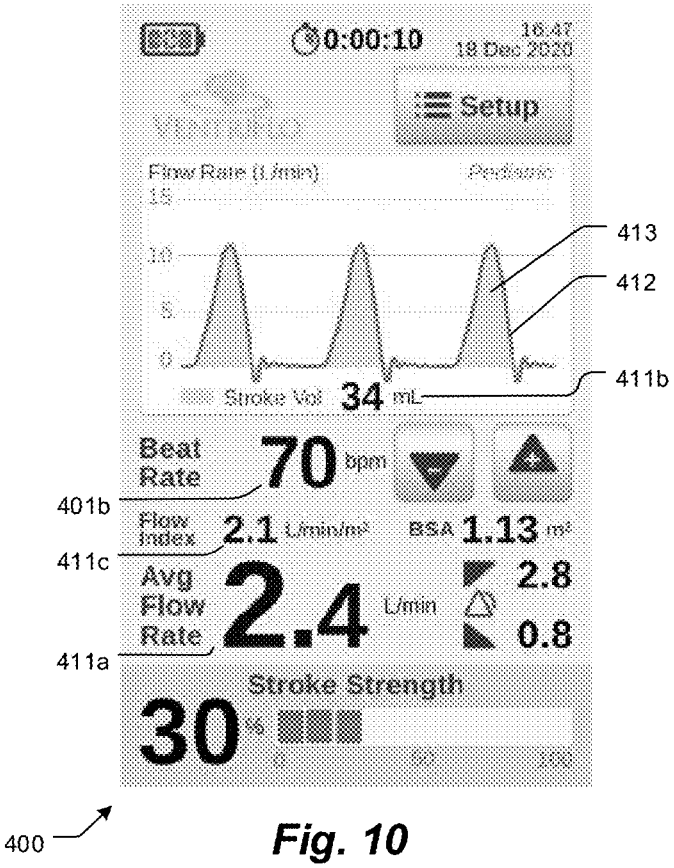
FIG. 10 shows typical operation of the graphic display 400.

As shown in FIG. 10, the graphic display 400 may show a set of flow-based attributes (a subset of physical flow characteristics), such as beat rate 401*b*, average flow rate

411*a*, stroke volume 411*b*, flow rate index 411*c*, the flow rate waveform 412, and/or the stroke volume waveform 413, as operator actuates the integral pump assembly 200 (shown in FIG. 9) via by the manual driver assembly 600 (not shown).

Figure 11A:
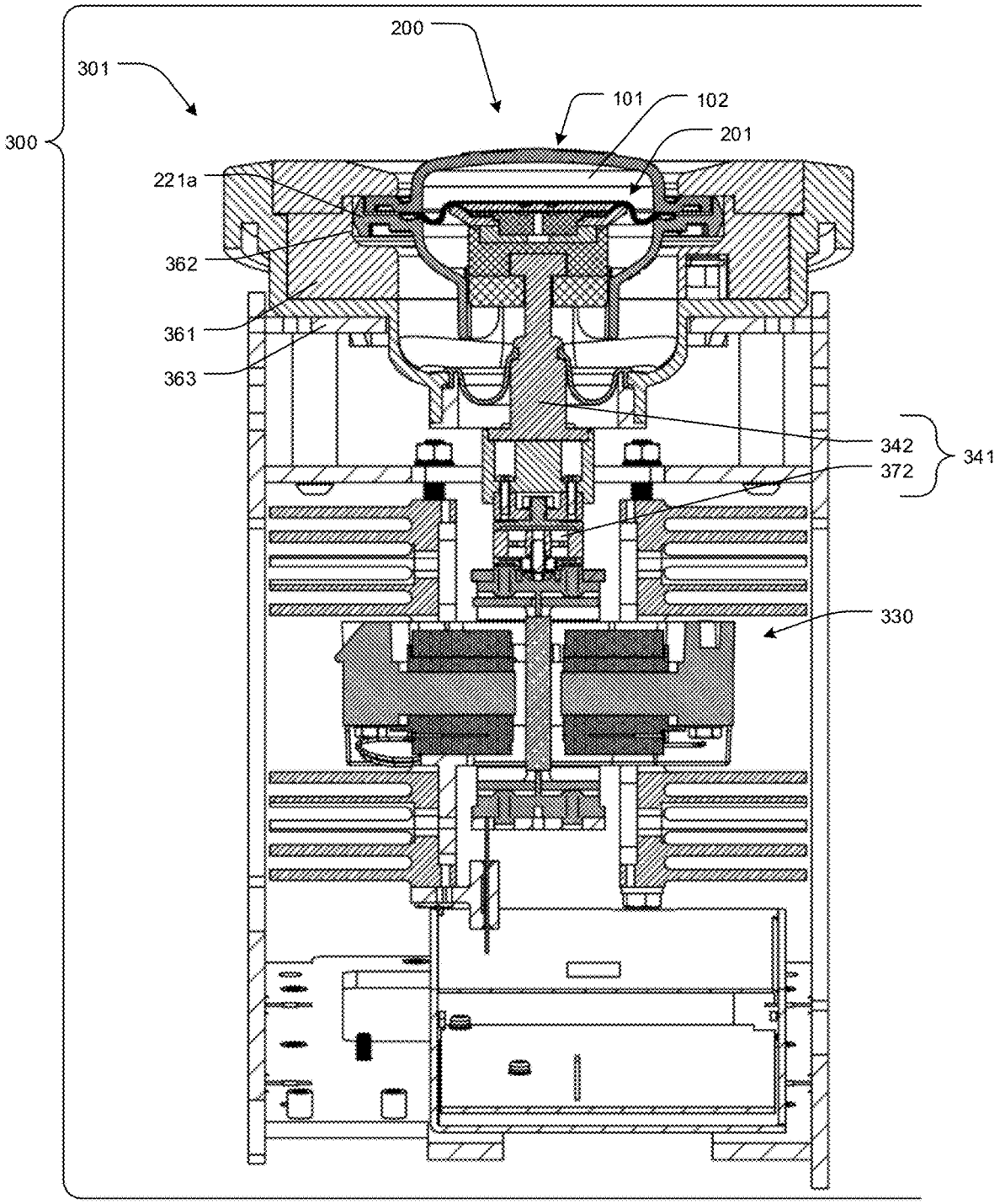
FIG. 11A is a vertical section of the pulsatile fluid pump apparatus 300 of FIG. 1 including the pulsatile fluid pump system 301 and the integral pump assembly 200 in the normal operating mode.

FIG. 11A is a vertical section of the pulsatile fluid pump apparatus 300 of FIG. 1 including the pulsatile fluid pump system 301 and the integral pump assembly 200. The pulsatile fluid pump system 301 includes, among other things, a linear motor 330, push rod assembly 341 (comprised of a push rod 342 and force sensor 372), control housing 361, and chassis 363. The integral pump assembly 200 (comprised of, among other things, a pump-valving assembly 101, with chamber 102, diaphragm assembly 201, and peripheral flange 221*a*), mounted in the normal operating position, is held by the peripheral flange 221*a* and compliant member (not shown) in the channel 362 within the control housing 361 of the pulsatile fluid pump system 301.

Figure 11B:
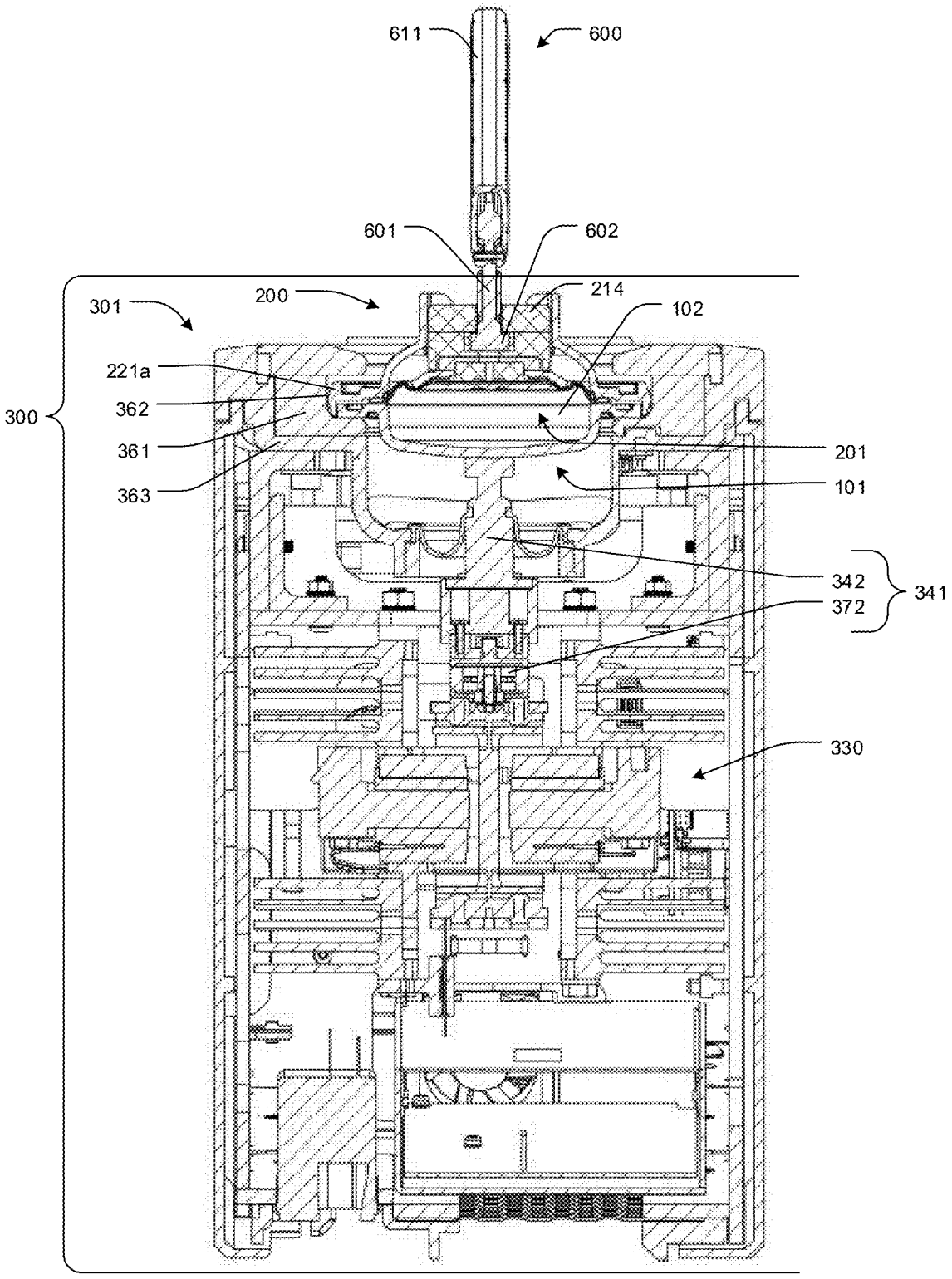
FIG. 11B is a vertical section of the pulsatile fluid pump apparatus 300 of FIG. 1 including the pulsatile fluid pump system 301 and the integral pump assembly 200 in the manual operating mode. The manual driver assembly 600 is shown attached to the integral pump assembly 200.

FIG. 11B is a vertical section of the pulsatile fluid pump apparatus 300 of FIG. 1 including the pulsatile fluid pump system 301 and the integral pump assembly 200. The pulsatile fluid pump system 301 consists of, among other things, a linear motor 330, push rod assembly 341 (comprised of a push rod 342 and force sensor 372), control housing 361, and chassis 363. An integral pump assembly 200 (comprised of, among other things, a pump-valving assembly 101 with chamber 102, diaphragm assembly 201, and peripheral flange 221*a*), mounted in the manual operating position, is held by the peripheral flange 221*a* and compliant member 221*c* (not shown) in the channel 362 within the control housing 361 of the pulsatile fluid pump system 301. The manual driver assembly 600 (comprised of, among other things, the spring-loaded arm 601, pump housing engagement pin 602, and handle 611) is shown attached to the integral pump assembly 200.

The pulsatile fluid pump system 301 is an ideal platform for manual operation of the integral pump assembly 200 utilizing the manual driver assembly 600 as: (a) the integral pump assembly 200 remains in a nearly spatial location regardless of whether the integral pump assembly 200 is in the normal operating position (FIG. 11A) or the manual operating position (FIG. 11B), thereby minimizing the need for the operator to reroute tubing, etc.; and (b) the mass of pulsatile fluid pump system 301 provides the necessary counter-acting force when the handle 611 is used to operate the integral pump assembly 200.

Figure 12A:
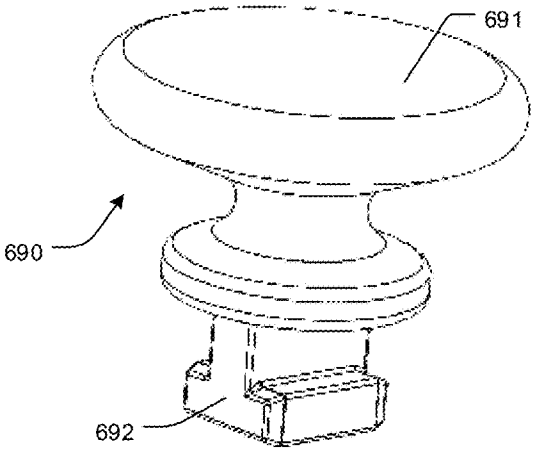
FIGS. 12A-D show a second embodiment of a manual driver assembly in accordance with the present invention.

FIGS. 12A D show a second embodiment of a manual driver assembly in accordance with the present invention. Although this embodiment lacks the mechanical advantage of the aforementioned manual driver assembly 600 (not shown), it is far simpler, being a manual driver knob assembly 690 which connects to the coupler slot 214*a* of the diaphragm assembly 201 by sliding the manual driver knob T-stem into the coupler slot 214*a*. The diaphragm assembly 201 is actuated by repeatedly pushing and pulling on the manual knob handle 691 relative to the integral pump assembly 200.

FIG. 12A shows a perspective view of the manual driver knob assembly 690, in accordance with an embodiment of the present invention, including a manual driver knob handle 691 attached to a manual driver knob T-stem 692.

Figure 12B:
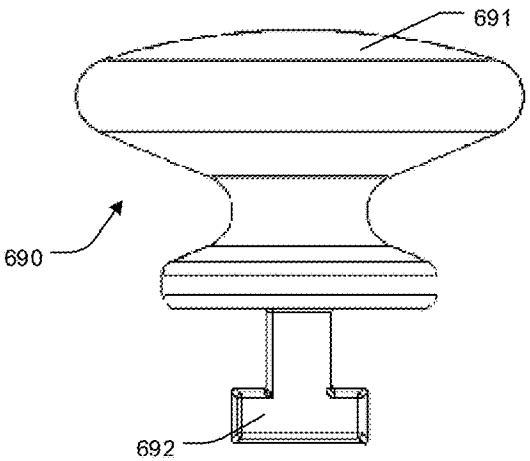

FIG. 12B shows a front view of the manual driver knob assembly 690 of FIG. 12A, including the manual driver knob handle 691 attached to the manual driver knob T-stem 692.

Figure 12C:
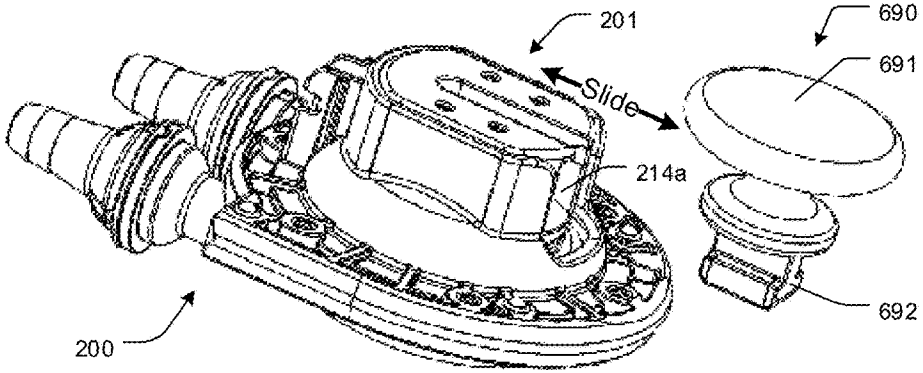

FIG. 12C shows the manual driver knob assembly 690 of FIG. 12A (comprised of manual driver knob handle 691 attached to a manual driver knob T-stem 692) immediately prior to attachment to the diaphragm assembly 201 via the coupler slot 214*a*. The integral pump housing 200 is in the manual operating position so that the manual driver knob assembly 690 may be attached to the diaphragm assembly 201 by sliding the manual driver knob driver T-stem 692 into the coupler slot 214*a*.

Figure 12D:
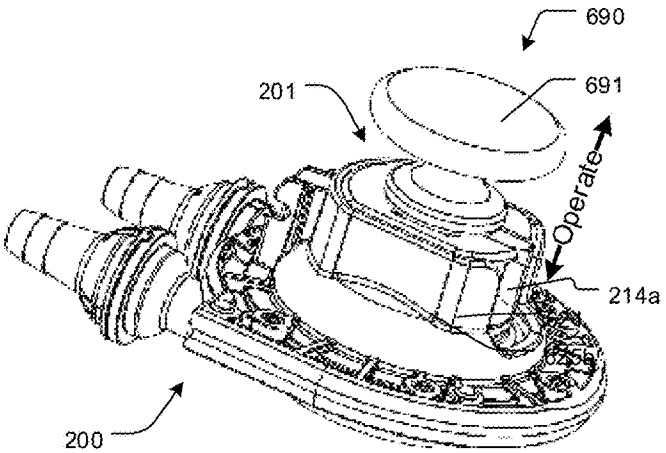

FIG. 12D shows the manual driver knob assembly 690 of FIG. 12A (comprised of manual driver knob handle 691 attached to a manual driver knob T-stem 692) after attachment to the diaphragm assembly 201 via the coupler slot 214*a*, ready for manual pumping. The integral pump housing 200 is in the manual operating position. The manual driver knob driver T-stem 692 is insider the coupler slot 214*a*. The diaphragm assembly 201 is actuated by pushing and pulling on the manual knob handle 691 relative to the integral pump assembly 200. The pump may be manually operated by holding the integral pump assembly 200 in one hand and grasping the manual driver knob handle 691 with the other, or by mounting the integral pump assembly 200 within the pulsatile fluid pump system 301 in the manual operating position and then actuating the manual driver knob handle 691 with one hand.

The embodiments of the invention described above are intended to be merely exemplary; numerous variations and modifications will be apparent to those skilled in the art. All such variations and modifications are intended to be within the scope of the present invention as defined in any appended claims.

What is claimed is:

1. A pulsatile fluid pump apparatus comprising:

an integral pump assembly employing a flexible diaphragm in a diaphragm assembly;

a manual driver assembly; and a pulsatile fluid pump system including a control housing;

the control housing and the integral pump assembly being configured for operation:

in a first mode, wherein the integral pump assembly is coupled to the control housing and the pulsatile fluid pump system reciprocally actuates the diaphragm assembly to cause pumping automatically, and in a second mode, wherein the integral pump assembly has been nondestructively removed from the control housing in a manner to expose the diaphragm assembly, the manual driver assembly configured to be coupled to the diaphragm assembly so that manipulation of the manual driver assembly reciprocally actuates the diaphragm assembly to cause pumping.

2. A pulsatile fluid pump apparatus according to claim 1, wherein the integral pump assembly is configured to operate in any spatial orientation.

3. A pulsatile fluid pump apparatus according to claim 1, wherein, for operation in the first mode, the diaphragm assembly has a normal orientation in the control housing so as to be in contact with a pushrod assembly to cause reciprocation of the flexible diaphragm.

4. A pulsatile fluid pump apparatus according to claim 1, wherein the integral pump assembly is configured to slide into and out of the control housing.

5. A pulsatile fluid pump apparatus according to claim 3, wherein the integral pump assembly is configured, in the second mode, to be in an inverted orientation in the control housing relative to the normal orientation of the diaphragm assembly, so as to expose the diaphragm assembly for convenient attachment of the manual driver assembly and wherein the pulsatile fluid pump system is not operationally connected to the integral pump assembly and therefore does not cause reciprocation of the diaphragm assembly.

6. A pulsatile fluid pump apparatus according to claim 5, wherein the control housing is configured to receive and hold the integral pump assembly in the inverted orientation.

7. A pulsatile fluid pump apparatus according to claim 1, wherein (i) the manual driver assembly includes an arm configured to be pivotally mounted to a housing of the integral pump assembly and (ii) the arm is coupled to a handle having a foot that reciprocally moves the diaphragm assembly when the handle is pumped.

8. A pulsatile fluid pump apparatus according to claim 1, wherein the manual driver assembly is a knob assembly.

9. A pulsatile fluid pump apparatus according to claim 7, wherein the manual driver assembly includes a stroke volume limiter, disposed between the handle and the foot, and configured to limit, by an adjustable amount, a change in stroke volume effectuated by the manual driver assembly.

10. A pulsatile fluid pump apparatus according to claim 9, wherein the stroke volume limiter defines a plurality of notched orientations, each orientation establishing a distinct limit on travel of the manual driver assembly.

11. A pulsatile fluid pump apparatus according to claim 1, wherein the pulsatile fluid pump system has an integral storage location for stowing the manual driver assembly when it is not being used.

* * * * *